United States Patent [19]

Keritsis

[11] 4,364,401

[45] Dec. 21, 1982

[54] METHOD FOR SELECTIVE DENITRATION OF TOBACCO

[75] Inventor: Gus D. Keritsis, Richmond, Va.

[73] Assignee: Philip Morris Incorporated, New York, N.Y.

[21] Appl. No.: 240,981

[22] Filed: Mar. 5, 1981

Related U.S. Application Data

[63] Continuation-in-part of Ser. No. 127,386, Mar. 5, 1980, Pat. No. 4,301,817.

[51] Int. Cl.[3] ..... A24B 3/18; A24B 15/18; A24B 15/22; A24B 15/24

[52] U.S. Cl. ..... 131/297; 131/298

[58] Field of Search ..... 131/297, 298; 204/180 P, 301; 260/291; 240/180; 99/77

[56] References Cited

U.S. PATENT DOCUMENTS

| | | | |
|---|---|---|---|
| 3,139,435 | 3/1963 | Staley et al. | 260/291 |
| 3,145,717 | 10/1964 | Osborne et al. | 131/141 |
| 3,369,906 | 12/1963 | Chen | 99/77 |
| 3,616,801 | 11/1971 | Hind | 131/297 |
| 3,847,164 | 11/1973 | Mattina et al. | 131/143 |
| 4,131,117 | 12/1976 | Kite et al. | 131/140 C |
| 4,131,118 | 11/1976 | Gellatly et al. | 131/140 C |
| 4,253,929 | 3/1981 | Keritsis | 131/297 |

FOREIGN PATENT DOCUMENTS 2816427 4/1978 Fed. Rep. of Germany .

*Primary Examiner*—V. Millin

*Attorney, Agent, or Firm*—Arthur I. Palmer, Jr.; James E. Schardt

[57] ABSTRACT

A process for selectively denitrating tobacco by electrodialysis to thereby reduce the delivery of various gas phase components, during combustion of tobacco products is disclosed. The process comprises forming an aqueous tobacco extract, separating the extract from the fibrous tobacco portion, selectively denitrating the extract and reapplying the denitrated extract to a fibrous tobacco portion. Denitration of the extract is effected by circulating the extract through those cells of an electrodialysis unit having anion permeable membrane towards both anode and cathode, said extract cells being paired on their anode side with brine cells which have a cation permeable membrane toward the anode. The cell pairs are separated by cells through which an acid is circulated. Smoking products containing tobacco treated in accordance with the invention exhibit reduced delivery of nitrogen oxides during combustion.

4 Claims, 1 Drawing Figure

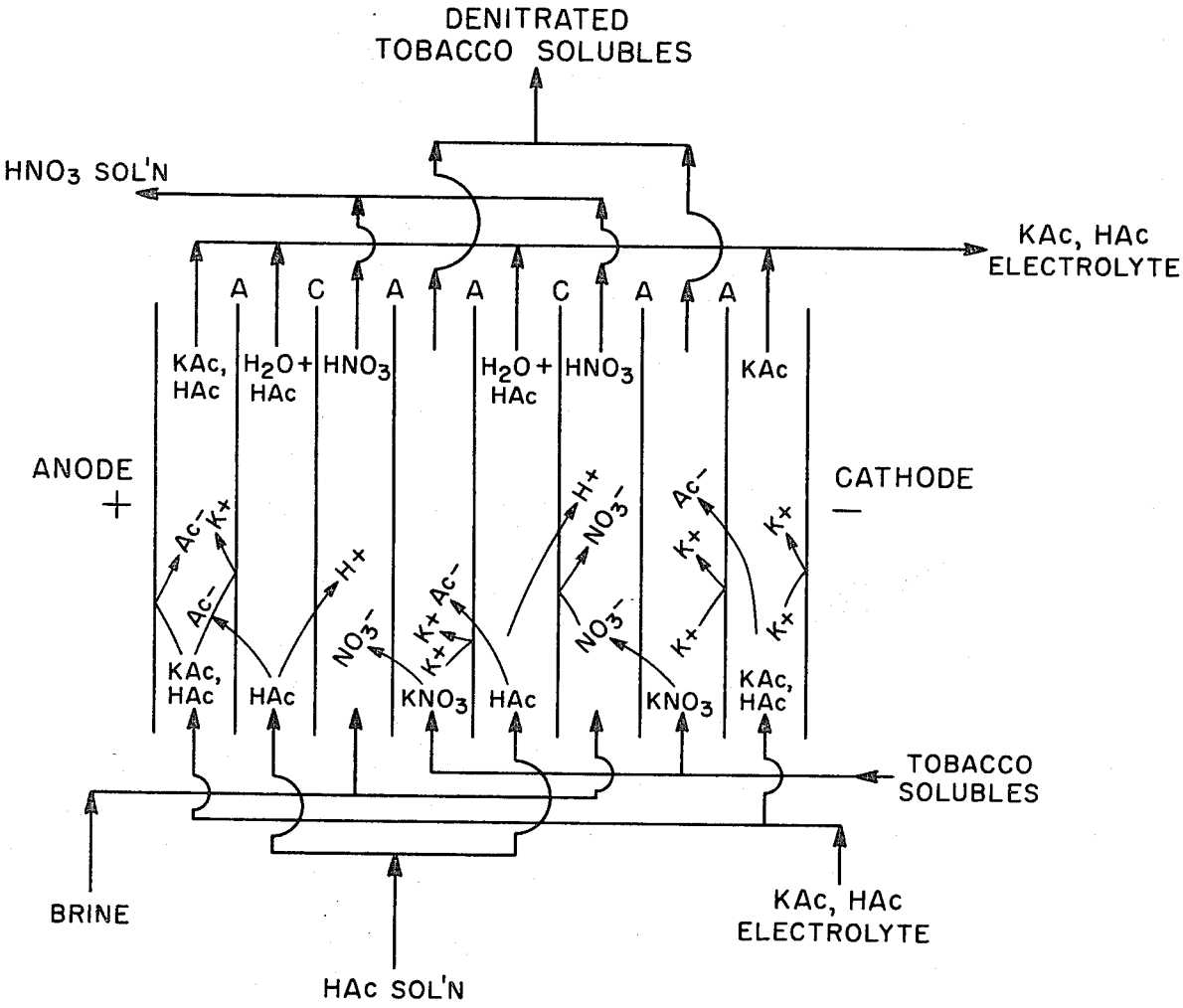
DENITRATED
TOBACCO SOLUBLES
HNO3 SOL'N
KAc, HAc
ELECTROLYTE
A
C
A
A
C
A
A
KAc,
HAc
H2O+
HAc
HNO3
H2O+
HAc
HNO3
KAc
ANODE
+
CATHODE
−
Ac−
K+
H+
NO3−
KAc,
HAc
HAc
KNO3
HAc
KNO3
KAc,
HAc
TOBACCO
SOLUBLES
BRINE
KAc, HAc
ELECTROLYTE
HAc SOL'N

METHOD FOR SELECTIVE DENITRATION OF TOBACCO

This application is a continuation-in-part of parent application Ser. No. 127,386 filed Mar. 5, 1980 now U.S. Pat. No. 4,301,817 issued Nov. 24, 1981.

BACKGROUND OF THE INVENTION (1) Field of the Invention

This invention relates to improved means for selectively removing precursors of nitrogen oxides from tobacco without substantial removal of potassium by means of electrodialysis. In accordance with the invention, selective denitration is effected in an electrodialysis stack wherein an acid solution circulates through certain cells in the stack. By means of the stack arrangement of the invention, nitrate removal can be selectively effected without use of bipolar membranes, the availability and construction of which may present problems in operating and commercializing a process for selective denitration of tobacco by means of electrodialysis.

(2) Description of the Prior Art

Tobacco contains a number of nitrogen containing substances which during the burning of the tobacco yield various components in the smoke. Removal of some of these smoke components, such as the oxides of nitrogen, is considered desirable.

Nitrate salts, such as potassium, calcium and magnesium nitrates, are a major class of nitrogenous substances which are precursors for nitrogen oxides, especially nitric oxide. These nitrate salts are normally found in great abundance in burley tobacco stems and strip and to a lesser extent in flue-cured tobacco stems and in reconstituted tobaccos which utilize these components. Attempts have been made to reduce or remove the nitrate from these tobaccos to bring about a significant reduction in the oxides of nitrogen delivered in their smoke. Among the techniques which have been employed to this end are extraction methods whereby the nitrates are removed from the tobacco material.

In accordance with extraction techniques, tobacco materials are generally contacted with water. In this manner, an extract containing the tobacco solubles including the nitrates, is formed. The extract is collected and may be discarded or may be treated to remove the nitrates. The denitrated extract may thereupon be reapplied to the fibrous insoluble tobacco material from which it was originally removed.

Although extract treatment methods seek to minimize the removal of materials other than nitrates from the tobacco and thereby avoid affecting the subjective characteristics of the tobacco or its filling capacity, burn qualities and the like, other materials are in fact removed by such methods. For example, the nitrates are commonly removed as potassium salts. Specifically, U.S. Pat. Nos. 4,131,118 and 4,131,117 describe a denitration process wherein potassium nitrate is crystallized from an aqueous tobacco extract followed by reapplication of the denitrated extract to the tobacco. In U.S. Pat. No. 3,847,164 denitration is effected by means of ion-retardation resins which retard ionic material, specifically potassium nitrate, in tobacco extract, while non-ionic constituents pass unaffected. Thus, these methods remove not only nitrate ions, but also potassium ions.

In addition to denitration, extraction processes are employed where removal of other tobacco components is desired. For example, U.S. Pat. No. 3,616,801 describes a process for improving the tobacco burn properties, smoke flavor and ash by controlling the ion content of the tobacco. In accordance with the process therein disclosed the proportion of metallic ions in an aqueous tobacco extract is adjusted, followed by reapplication of the treated extract to the tobacco. Among the treatments suggested for adjusting the metal ion content are ion exchange and membrane electrodialysis. Removal of potassium ions and their replacement with ammonium, hydrogen, calcium or magnesium ions are particularly desirable in the practice of this process. Levels of other ions including nitrate may also be adjusted to alter the tobacco properties. In Example 6, over 50% of both nitrate and potassium ions were removed by means of electrodialysis.

In parent application Ser. No. 127,386, now U.S. Pat. No. 4,301,817, a denitration method is described wherein nitrate is removed from tobacco extract while the potassium ion level is maintained substantially intact. By such selective denitration a proportionately greater reduction in delivery of nitrogen oxides in tobacco smoke relative to degree of nitrate removal is achieved than when the potassium ions are also removed. Electrodialysis is one means described for effecting selective denitration. In the described process, extract is circulated through those cells of an electrodialysis unit having an anion permeable membrane toward the anode and a bipolar membrane toward the cathode while brine is circulated through alternate cells having the reverse membrane set-up.

Bipolar membranes formed by uniting anion and cation impermeable membranes often exhibit nonuniform joinder resulting in a very resistant bipolar membrane. It has now been discovered that the use of bipolar membranes can be avoided without reducing the efficacy of the previously described process. Such avoidance is possible by separation of the brine-extract cell pairs with an acid solution confined between an anion permeable and a cation permeable membrane rather than with a bipolar membrane. The acid solution further serves to neutralize the denitrated tobacco extract and in some cases the brine, thereby preventing pH rises and resultant precipitation of salts of multivalent cations in the membranes.

SUMMARY OF THE INVENTION

The present invention provides a method for selectively denitrating tobacco by means of electrodialysis whereby a reduction of various gas phase components of tobacco smoke is achieved. Specifically, the selective denitration is effected without resort to bipolar membranes.

In accordance with the present invention, tobacco materials are contacted with an aqueous solution to obtain an aqueous extract and an insoluble fibrous tobacco residue. The extract and the insoluble fibrous materials are separated whereupon the extract is denitrated to selectively extract the nitrate ions without substantially reducing the potassium ion content. Selective denitration is effected by circulation of the extract through cells of an electrodialysis unit having anion permeable membranes toward both the anode and the cathode, said extract cells being paired with cells through which brine is circulated, said brine cells being adjacent the extract cells on the anode side and having a cation permeable membrane toward the anode, and said cell pairs being separated by cells through which an acid having an anion which forms soluble salts with polyvalent cations is circulated. The denitrated extract may then be applied to an insoluble fibrous tobacco portion. Smoking tobacco roducts containing tobacco which has been treated in this manner produce relatively less nitric oxide than products from which the same amount of nitrate has been removed along with potassium ions.

BRIEF DESCRIPTION OF THE DRAWING

The FIGURE is a schematic diagram of an electrodialysis stack which may be employed to practice the method of the invention.

DETAILED DESCRIPTION OF THE INVENTION

In accordance with the present invention tobacco is denitrated in a manner which enhances the relative reduction in delivery of oxides of nitrogen. This is accomplished by removal of nitrate ions, without concomitant removal of potassium ions present in the tobacco material, employing electrodialysis. By avoiding removal of the potassium ions a greater reduction in nitrogen oxide delivery, particularly nitric oxide, is achieved than is achieved with denitration techniques which reduce not only the levels of nitrate ions, but also potassium ion levels.

In the practice of the process, the tobacco material is typically contacted with an aqueous solution in order to extract the soluble components, including potassium and nitrate salts. The aqueous solution employed may be water, but preferably is a denitrated aqueous extract of tobacco containing tobacco solubles. The extraction can be effected using a 5:1 to 100:1 aqueous solution to tobacco ratio (w/w) at 20°-100° C., preferably 60°-95° C., for a period of time ranging from a few seconds to several minutes depending on the particular temperature and volume of water or solubles used. In order to maximize the extraction of nitrate, the wetted tobacco is generally pressed or centrifuged at the end of the extraction time whereby the excess water and residual nitrate that may be present on the tobacco surface and in suspension are removed. By employing this mode of operation the need for excessive drying of the tobacco to remove the excess moisture can be avoided.

The resulting aqueous tobacco extract is separated from the insoluble fibrous tobacco residue. The extract and the insoluble material may be separated by conventional solid-liquid separation techniques. For example, pressing, centrifugation or filtration techniques may be employed.

The separated extract is subjected to electrodialysis such that the major precursors of oxides of nitrogen in smoke are removed while maintaining the potassium ion level substantially intact. As used herein, selective denitration refers to removal of such nitrogen oxide precursors without substantial potassium removal. Nitrate ions are the principal nitrogen containing components removed according to the present invention. These ions are believed to be the major source of oxides of nitrogen, particularly nitric oxide, during combustion.

Extraction of nitrate ions from tobacco without substantially reducing the potassium ion level results in a proportionately greater reduction in delivery of oxides of nitrogen during combustion relative to nitrate removal, than is generally effected where potassium ions are removed during the denitration step. For purposes of the present invention references to reduction in gas phase components are intended to mean reduction in nitrogen oxides.

In order to effect reduction of gas phase components of tobacco smoke in accordance with the present invention, membrane electrodialysis is employed. By selection of the appropriate sequence of membranes, the nitrate levels can be reduced while the potassium levels remain substantially intact.

In a membrane electrodialysis set-up, the membranes are arranged in stacks which are disposed between an anode and a cathode. In the practice of the present process the stacks contain anion permeable and cation permeable membranes separated by appropriate spacers to form brine and extract cell pairs. The cell pairs are separated by an acid solution. The spacers are specially designed and manifolded to provide uniform flow distribution of tobacco extract passing between the membranes which alternately concentrate and dilute the ionic species ($NO_3^-$-) in the tobacco extract in contact with them.

The tobacco extract flows through cells which have anion permeable membranes toward both the anode and the cathode. The extracting medium or brine flows through cells which are adjacent to the extract cells on the extract cells' anode side. These brine cells have a cation permeable membrane toward the anode and toward the cathode, share the tobacco extract anion permeable membrane. In turn the acid solution cells are confined between the tobacco extract cells' other anion permeable membrane and the cation permeable membrane of the brine cell.

The anions present in the tobacco extract cells, specifically the nitrate ions, migrate toward the anode upon imposition of an electrical potential. Thus nitrate ions in the tobacco extract migrate into adjacent brine cells where they remain, are concentrated and can be removed from the system. On the other hand, the potassium ions are retained in the tobacco extract by the anion permeable membrane toward the cathode when a potential is applied.

The electrodes employed in the electrodialysis unit may be carbon, stainless steel, platinum or other type of noncorrosive conductive material that does not react with the electrolyte and does not introduce metallic ions in solution, especially polyvalent ions such as $Cu^{++}$ and $Al^{+++}$, that may react with the ionic membrane or with the tobacco solubles and cause membrane fouling and/or scaling on the membrane surface. Preferably hastelloy carbon cathode plates and platinized niobium anode plates are employed.

The solutions in the electrode cells may be different for the anode and the cathode, but preferably are the same. These electrolyte solutions should comprise an approximately 0.1 N solution of an alkali metal salt, preferably a potassium salt of an anion that will not react and will create minimum gas at the electrodes or of an anion that will not foul the membranes nor precipitate polyvalent cations such as Ca, Mg, Al, etc. at the surface of the membranes, especially at the particular pH being used. Salts that are particularly preferred are potassium acetate and sulfate at a pH of about 2-5. An alternative electrolyte solution consisting of an acid such as acetic, sulfuric, etc. at a pH of about 2-5 instead of the acidified K-salt of these acids could be used. Care should also be taken in this case to select acids whose anions do not create a gas or precipitate at the electrode especially at the particular pH used.

The purpose of the electrolyte solution is three-fold, namely to increase and maintain the conductivity of the solution, to cool the electrodes and make them more efficient conductors, and to remove the hydrogen or other gas bubbles that accumulate on the electrode surfaces. The electrolyte is continuously recirculated to an electrolyte container which is vented to allow hydrogen or other gases to escape thereby preventing it from being recirculated to the electrodes. To assist in preventing the recirculation of dissolved hydrogen or the accumulation of gas (hydrogen) bubbles on the electrodes a non-ionic wetting agent, such as glycerine, Triton X-100, or the like may be employed. In addition, circulation of the electrolyte at a rapid rate will facilitate removal of oxygen or hydrogen gas bubbles from the electrodes.

The membranes employed to isolate the electrodes may be bipolar or cation impermeable membranes of the same nature and thickness as those used in the overall stack. However, these membranes are preferably thicker, more ionic and tighter (less porous). Also, the spacers that are placed between the electrodes and the anode-cathode membranes may be of the same thickness as those used in the overall stack, but preferably they should be thicker, i.e., about twice the thickness of the remaining spacers to allow a greater circulation ratio of electrolyte on the surface of the electrodes.

The acid solution may be any acid which forms soluble salts with multivalent cations, such as $Mg^{++}$ and $Ca^{++}$. For example acetic or hydrochloric acid may be employed. Alternatively the solution may be any acceptable electrolyte system described above. In the case where an acidified potassium salt solution is employed both the brine and tobacco solubles are neutralized. To avoid transport of the anion of the acid from the tobacco extract cell into the brine cell, it is preferable to employ an acid the anion of which is relatively slow-moving. Thus acetic acid and its acidified potassium salt are particularly preferred acid solutions.

The brine solution will typically be aqueous. It is preferable that a small concentration of ionic material be present in the brine during the initial phase of operation in order to create some conductivity. Thus for example the brine may initially be seeded to 0.1 weight percent potassium or sodium nitrate, chloride or acetate, or nitric, hydrochloric, or acetic acid or with potassium of sodium hydroxide. In general the initial seeding of the brine to about 0.1 weight percent should be made with ions that are water soluble and will not affect the membranes. The brine may be recirculated through the system until the extraction of nitrate ions thereby is no longer efficiently effected.

The anion permeable membranes have a positive fixed electrical charge. Such positively charged membranes attract and pass anions and repel cations. The cation permeable membranes used in the present arrangement are negatively charged and thus attract and pass cations and repel anions.

The number and dimensions of the cells will depend upon the desired treatment rates, the size of commercially available membranes, the viscosity of the aqueous tobacco solubles and the need to maintain an acceptable flow rate at a pumping pressure below the rupturing point of the membranes. Other factors that determine the number and dimension of cells are the operating voltage, the amount of nitrate in the aqueous tobacco solubles, the solubles temperature, the desired degree of denitration, the resistivity of the membranes and the distance or thickness of the cells, and the desired mode of operation, viz. continuous vs. batch. Generally for a given system (voltage, nitrate level, treatment rate) the thinner, the more ionic and the smaller the spacing between the cell membranes, the smaller the membrane area or the fewer the cells required. Distances in the order of $\leqq 0.04$ inches have been found to be greatly preferred. The same is true when the applied voltage and the solubles temperature increase, with the limiting factors on upper voltages and operating temperatures being the nature of the membranes and spacers. The temperature should be below the critical temperature for the membranes and spacers to avoid damage; the voltage should be such as to avoid electrolysis and minimize transference of other tobacco substances, ionic or non-ionic in nature.

Although the membranes are relatively impermeable to non-ionic species, some transfer of non-ionic species and water will occur. The amount of such transfer depends on the amount of current passed through the membrane, the size of the non-ionized molecule and the "tightness" of the membrane.

The concentration of the tobacco extract is generally limited by flow rate which depends on the presence of substances that increase the extract's viscosity on the one hand and efficient denitration which depends on the concentration of nitrate ions on the other. Concentrations should be kept low enough to avoid membrane deposits and to permit flow without excessive resistance. As a practical matter, viscosity is the upper limit for tobacco extract concentration. At the low end of the range, the power required relative to the degree of deionization becomes the limiting factor. It has been found that the preferred concentrations of tobacco extract range between 5–50% solids having a low resistivity of 8–50 ohm-cm, more preferably 10–30% solids and a resistivity of 10–30 ohm-cm.

In operation the current density in amps per square centimeter of membrane greatly depends on the ionic strength or resistivity of the tobacco extract, the membranes, the amount of voltage or potential that is being applied, the operating temperature of the stack, the cell thickness, and the resistivity imposed by a certain amount of deposit of tobacco solids on the membrane surfaces which again depends on viscosity and flow rates. Preferably, the amount of voltage applied should be between 0.5 and 2.0 volts per cell pair. The limiting factors for the desired voltage are the larger capital investment for cells required when the lower voltages are used and the greater transfer of non-ionic species across the membranes and the greater probability of membrane "fouling" when the higher voltage is applied. Other limiting factors are cell thickness (spacing between membranes), membrane tightness, resistance, ionic strength of the tobacco solubles and membranes and the operating temperature of the system.

The FIGURE is a schematic representation of the operation of an electrodialysis stack which may be employed in the practice of the invention. The potassium nitrate containing tobacco extract is fed into those cells of the stack which have anion permeable membranes A toward both the anode and the cathode. Brine is in turn circulated in the cells on the anode side of the tobacco extract cells. The brine cells have a cation permeable membrane C toward the anode. Acetic acid electrolyte is circulated through cells formed from the anion permeable membrane on the cathode side of the tobacco extract cell and the cation permeable membrane of the brine cell. The electrolyte as exemplified in the FIGURE is a potassium acetate solution. The nitrate ions migrate from the extract through the membranes A toward the anode (+) into the brine cells and are passed out of the system as a $HNO_3$ solution. The potassium ions present in the tobacco extract cannot pass through membrane A on the cathode (−) side and thus remain in the extract when it leaves the system.

It is of course readily apparent that selective removal of cations from tobacco extracts may be accomplished in a manner similar to that described herein. Rather than the arrangement herein described, however, the extract would circulate between cation permeable membranes and the brine would be on the cathode side of the extract and have an anion permeable membrane toward the cathode.

Following the selective denitration of the tobacco extract, the extract is recombined with the insoluble tobacco material from which it was removed. Prior to reapplication the extract may be concentrated if necessary or desired. Concentration may be accomplished by evaporation methods, such as thin film flash evaporation, reverse osmosis or ultra-microfiltration, as well as other conventional concentration techniques. The reapplication may be effected by any suitable means such as spraying, coating, dipping or slurry processes. The tobacco may then be dried or otherwise processed to put it in condition for use in tobacco products.

The thus treated tobacco may be used in any smoking tobacco product desired. Any such smoking tobacco product will exhibit reduced delivery of nitrogen oxides during combustion. Further, the ratio of nitrogen oxide reduction to nitrate removed for products formed from tobacco treated in accordance with the invention is greater than that for products containing tobacco which has not been selectively denitrated.

In order to minimize loss of solubles other than nitrate, extraction of the tobacco material may be effected with denitrated tobacco extracts. By means of this expedient it is possible to reduce the amount of non-nitrate materials removed since after several extractions the extract liquor will approach saturation. Thus, except for the nitrates, reduced amounts of materials will be removed during subsequent extraction steps. This is a preferred mode of operation for treating tobacco strip or tobacco to be reconstituted.

It is to be understood that the process of the invention may be employed with whole cured tobacco leaf, cut or chopped tobacco, tobacco filler, reconstituted tobacco, tobacco stems and the like. As used herein, references to tobacco and tobacco materials are to be understood to include all such forms of tobacco. Further it is to be understood that the tobacco treated in accordance with the invention reduces nitrogen oxide delivery in any tobacco product which is consumed by combustion and that reference to smoking tobacco products include cigars, cigarettes, cigarillos and the like.

EXAMPLE 1

Four liters of aqueous tobacco extract containing 25% tobacco solubles and 0.46% $NO_3$-N were denitrated via electrodialysis in the following manner.

The electrodialysis unit was set up to form seven tobacco extract and brine cell pairs alternating with eight cells of acetic acid adjusted to a pH of 5. Two of the acetic acid cells served as electrolyte cells—one at the anode and one at the cathode.

The extract cells were confined between two anion permeable membranes. The brine cells were on the anode side of the extract cells and had a cation permeable membrane toward the anode and the anion permeable membrane of the extract cell toward the cathode.

The membrane stack was 9"×10" with an effective membrane area of 1.75 $ft^2$. The membranes used were Ionics' 103 QZL anion and 61 CZL cation permeable membranes. These membranes were separated by polypropylene spacers 0.04" thick. The membranes in front of the electrodes were Ionics' 103PZL-389 heavy anion permeable membranes. Both membranes were separated from the electrodes with 0.08" thick polypropylene spacers. A platinum-niobium anode and a stainless cathode were employed.

The temperature of the various solutions (tobacco solubles, brine, and electrolyte) was maintained between 80°-90° F. during the run. The flow rate at 23 psi pumping pressure was set at 1200 cc/minute. When an electrical potential of 20 volts across the stack was applied, the nitrate and chloride ions were transported from the tobacco solubles towards the anode. These ions passed through the anion permeable membranes into the brine cells where they were retained by the similarly charged cation permeable membranes and concentrated. Similarly, the acetic ions of the electrolyte were transported from the electrolyte towards the anode. The acetate ions passed through the anion permeable membranes into the tobacco solubles cells where they neutralized the cations of the nitrate and chloride salts. The results of this run are given in Table I.

TABLE I

| Time in | TOBACCO SOLUBLES | | ED - Brine | | | |
|---|---|---|---|---|---|---|
| minutes | $NO_3$—N % | $NO_3$—N Reduction % | $K^+$ % | $Ca^{++}$ % | $Mg^{++}$ % | $NO_3$—N % |
| 0 | 0.458 | — | <0.4 | <0.1 | <0.1 | ND |
| 60 | 0.357 | 22.1 | | | | |
| 120 | 0.318 | 30.6 | | | | |
| 180 | 0.271 | 40.8 | | | | |
| 240 | 0.185 | 59.6 | | | | |
| 300 | 0.121 | 73.6 | | | | |
| 360 | 0.090 | 80.3 | | | | |
| 420 | 0.069 | 84.9 | | | | |
| 480 | 0.028 | 93.9 | 0.4 | <0.1 | <0.1 | 0.29 |

EXAMPLE 2

Four liters of aqueous tobacco extract were treated in an electrodialysis unit similar to that of Example 1, except 14 tobacco extract/brine cell pairs and 15 acid cells were employed. This resulted in an effective membrane area of 3.50 square feet. In addition the acid solution strength was increased from 0.1 N to 1.0 N. Finally an electrical potential of 30 volts was applied. The analytical data and results of this run are set forth in Tables II and III.

TABLE II

| | Before Treatment | After Treatment |
|---|---|---|
| Dry weight basis, Percent Tobacco Solids in Solution | 23.5 | 17.8 |
| $K^+$ | 14.0 | 12.4 |
| $Na^+$ | 0.13 | 0.17 |
| $Ca^{++}$ | 1.62 | 1.69 |
| $Mg^{++}$ | 0.85 | 0.96 |
| Total Nitrogen | 5.11 | 3.48 |
| $NO_3^-$—N | 2.13 | 0.11 |
| $Cl^-$ | 3.15 | 0.06 |

TABLE II-continued

| | Before Treatment | After Treatment |
|---|---|---|
| Alkaloids | 2.43 | 2.36 |
| Ash | 36.6 | 36.0 |

TABLE III

| Treatment Time, Minutes | TOBACCO SOLUBLES $NO_3^-$—N % | pH |
|---|---|---|
| 0 | 0.53 | 5.66 |
| 20 | 0.40 | 5.82 |
| 40 | 0.34 | 5.76 |
| 60 | 0.31 | 5.69 |
| 80 | 0.26 | 5.61 |
| 100 | 0.21 | 5.51 |
| 120 | 0.17 | 5.43 |
| 140 | 0.13 | 5.33 |
| 160 | 0.09 | 5.24 |
| 180 | 0.07 | 5.19 |
| 200 | 0.05 | 5.07 |
| 220 | 0.05 | 5.03 |
| 240 | 0.04 | 4.96 |
| 260 | 0.03 | 4.96 |

What is claimed is:

1. A method of selectively removing nitrate ions from tobacco without substantially reducing the potassium ion level comprising:

(a) contacting a tobacco material with an aqueous solution to form an aqueous extract having a solids content of about 5–50% and a resistivity of 8–50 ohm-cm and an insoluble tobacco residue;

(b) separating the aqueous extract from the insoluble tobacco residue;

(c) selectively denitrating the separated aqueous extract by circulation through cells of an electrodialysis unit having anion permeable membranes toward both the anode and the cathode said extract cells being paired with cells through which brine is circulated, said brine cells being adjacent the extract cells on the anode side and having a cation permeable membrane toward the anode, and said cell pairs being separated by cells through which an acid solution is circulated, said acid having an anion which forms soluble salts with polyvalent cations; and (d) combining the denitrated aqueous extract obtained from step (c) with the insoluble tobacco residue which was removed from the aqueous extract in step (b).

2. The method of claim 1 wherein the acid solution is acetic acid.

3. The method of claim 1 wherein the aqueous solution is a denitrated aqueous tobacco extract containing tobacco solubles.

4. The method of claim 1 wherein the brine solution contains at least 0.1 weight percent ionic material.

* * * * *